US008882563B2

(12) United States Patent
Boo et al.

(10) Patent No.: US 8,882,563 B2
(45) Date of Patent: Nov. 11, 2014

(54) CHEMICAL MECHANICAL POLISHING SYSTEM

(75) Inventors: Jae Phil Boo, Gyeonggi-do (KR); Dong Soo Kim, Gyeonggi-do (KR); Keon Sik Seo, Gyeonggi-do (KR); Chan Woon Jeon, Gyeonggi-do (KR); Jun Ho Ban, Gyeonggi-do (KR); Ja Cheul Goo, Gyeonggi-do (KR)

(73) Assignees: Samsung Electronics Co., Ltd, Suwon-Si, Gyeonggi-Do (KR); K.C. Tech Co., Ltd., Anseong-Si, Gyeonggi-Do (KR)

( * ) Notice: Subject to any disclaimer, the term of this patent is extended or adjusted under 35 U.S.C. 154(b) by 842 days.

(21) Appl. No.: 13/095,404

(22) Filed: Apr. 27, 2011

(65) Prior Publication Data

US 2011/0269378 A1 Nov. 3, 2011

(30) Foreign Application Priority Data

Apr. 30, 2010 (KR) ..... 10-2010-0041121

(51) Int. Cl.

| | |
|---|---|
| ***B24B 49/00*** | (2012.01) |
| ***B24B 5/00*** | (2006.01) |
| ***B24B 37/30*** | (2012.01) |
| ***B24B 37/34*** | (2012.01) |

(52) U.S. Cl.

CPC ..... *B24B 37/345* (2013.01); *B24B 37/30* (2013.01)

USPC ..... 451/9; 451/285

(58) Field of Classification Search

USPC ..... 451/5, 6, 9–11, 28, 41, 285–289, 397, 451/398, 65, 114, 159, 259

See application file for complete search history.

(56) References Cited

U.S. PATENT DOCUMENTS

| | | | | |
|---|---|---|---|---|
| 6,602,724 | B2 | 8/2003 | Redeker et al. | 438/5 |
| 6,860,798 | B2 * | 3/2005 | Castor | 451/288 |
| 6,869,332 | B2 | 3/2005 | Redeker et al. | 451/6 |
| 6,878,038 | B2 | 4/2005 | Johansson et al. | 451/6 |
| 6,896,584 | B2 * | 5/2005 | Perlov et al. | 451/5 |
| 6,924,641 | B1 | 8/2005 | Hanawa et al. | 324/230 |
| 6,930,478 | B2 | 8/2005 | Hanawa et al. | 324/230 |
| 6,975,107 | B2 | 12/2005 | Hanawa et al. | 324/230 |
| 7,001,242 | B2 | 2/2006 | Birang et al. | 451/5 |
| 7,001,246 | B2 | 2/2006 | Hanawa et al. | 451/8 |
| 7,008,297 | B2 | 3/2006 | Johansson et al. | 451/6 |
| 7,118,457 | B2 | 10/2006 | Swedek et al. | 451/41 |

(Continued)

FOREIGN PATENT DOCUMENTS

KR 10-2005-12586 2/2005 ..... H01L 21/304

*Primary Examiner* — Doug Van Nguyen

(74) *Attorney, Agent, or Firm* — Kusner & Jaffe

(57) ABSTRACT

The invention relates to a chemical mechanical polishing system, comprising: at least one polishing platens rotatably installed with a platen pad mounted on its upper surface; a guide rail disposed along a predetermined path; a substrate carrier unit including a rotary union to downwardly press a substrate during a polishing process, the substrate carrier unit moving along the guide rail with loading the substrate; and a docking unit installed to be docked to the substrate carrier unit so as to supply air pressure to the rotary union which downwardly presses the substrate held by the substrate carrier unit, when the substrate carrier unit is positioned over the polishing platen, whereby even though the substrate carrier unit is moved to consecutively polish the substrate on the plural polishing platens, it substantially removes a phenomenon of the twisting of air pressure supply tubes due to the movement of the substrate carrier unit.

9 Claims, 13 Drawing Sheets

(56) References Cited

U.S. PATENT DOCUMENTS

| | | | | |
|---|---|---|---|---|
| 7,229,340 | B2 | 6/2007 | Hanawa et al. | 451/8 |
| 7,374,477 | B2 | 5/2008 | Birang et al. | 451/527 |
| 7,591,708 | B2 | 9/2009 | Birang et al. | 451/5 |
| 7,729,207 | B2 | 6/2010 | Kawaguchi | 368/204 |
| 8,172,643 | B2 * | 5/2012 | Yilmaz et al. | 451/11 |
| 8,597,084 | B2 * | 12/2013 | Chen | 451/288 |
| 2001/0007810 | A1 * | 7/2001 | Moloney et al. | 451/72 |

* cited by examiner

CHEMICAL MECHANICAL POLISHING SYSTEM

FIELD OF THE INVENTION

The invention relates to a chemical-mechanical polishing system and its method, and more particularly to a chemical-mechanical polishing system in which even though a substrate carrier unit with loading a substrate moves through a circulatory path passing through a plurality of polishing platens, air pressure supply tubes for supplying compressed air to a rotary union are prevented from being twisted, thereby enabling to continuously polish the substrates loaded at the substrate carrier unit on the plurality of polishing platens.

BACKGROUND OF THE INVENTION

In general, a chemical-mechanical polishing process (CMP) is known as a standard process to polish the surface of a substrate, wherein a substrate like a wafer having a polishing layer relatively rotates against a polishing platen for manufacturing semiconductors.

FIGS. 1 to 3 are schematic views of a conventional chemical-mechanical polishing system. As shown in FIGS. 1 and 2, the chemical-mechanical polishing system comprises a polishing platen 10 driven to rotate with a platen pad 16 and a backing pad 15 which are attached to a platen base 14 on its upper surface, a substrate carrier unit 20 at which a substrate 55 is loaded for being pressed in the downward direction 22*d*' and rotating in the direction 22*d*, and a slurry supply part 30 for providing a slurry 30*a* on the upper surface of the platen pad 16.

As to the polishing platen 10, a rotational driving force by a motor 12 is delivered to a shaft 13 through a power transmission belt 11, so that the platen base 14 rotates together with the shaft 13. A backing layer 15 made of a soft material and a platen pad 16 for the polishing process are applied on the upper surface of the platen base 14, respectively.

The substrate carrier unit 20 includes a carrier head 21 for loading and holding the substrate 55, a rotating shaft 22 driven to rotate integrally with the carrier head 21, a motor 23 for driving the rotating shaft 22, a pinion 24 secured to a motor shaft and a gear 25 fixed to the rotating shaft 22 for transmitting the driving force of the motor 23 to the rotating shaft 22, a driving support 26 for rotatably receiving the rotating shaft 22, and a cylinder 27 for moving the driving support 26 upwards and downwardly and pressing down the substrate 55 against the platen pad 16.

In the chemical-mechanical polishing system as constructed above, the substrate 55 rotates and makes contact with the platen pad 16, while being pressed downwardly at an separated position from the rotating center of the platen pad 16, and also the platen pad 16 rotates simultaneously. When slurry 30*a* containing abrasives and chemical materials is supplied through the slurry supply tube 30 on the platen pad 16, the slurry is introduced to contact surfaces between the substrate 55 and the platen pad 16 through groove patterns with a predetermined width and depth in a X-Y direction on the upper surface of the platen pad 16, thereby polishing the surface of the substrate 55.

Meanwhile, constructions to press down the substrate 55 against the platen pad 15 can be embodied by a rotary union which drives fluids therein upon receiving an electrical signal, whose constructions are well disclosed in the Korean Laid-Open Patent No. 2004-75114.

In the chemical-mechanical polishing system as described above, the substrates 55 can be polished one by one by contacting the platen pad 16 after one substrate is loaded and held by the carrier head 21 of the substrate carrier unit 20. Alternatively, however, it can be constructed in a manner that a plurality of substrates 55 can be polished simultaneously as illustrated in the Korean Laid-Open Patent No. 2005-12586.

In other words, as shown in FIG. 3, a chemical-mechanical polishing system 1 has been used in which a carrier transporter 40 divided into a plurality of branches and installed rotatably about a rotating center 41 is provided, a carrier unit 20 is installed at the ends 40A, 40S and 40C of the carrier transporter 40, and when new substrates 55*s* and 55' are mounted on the carrier unit 20 by means of a substrate loading/unloading unit K, the carrier transporter 40 rotates to simultaneously polish a plurality of substrates 55 mounted at the ends 40A, 40S and 40C of the carrier transporter 40 on the respective polishing platens 10, 10' and 10".

However, though the conventional chemical-mechanical polishing system 1 shown in FIG. 3 is capable of simultaneously polishing a plurality of substrates 55 on the plural polishing platens 10, 10' and 10', it has to supply electricity or compressed air for driving the motor 23, the cylinder 27 or the rotary union to each substrate carrier unit 20 disposed at the ends 40A, 40S and 40C of the carrier transporter 40. Hence, since the air pressure supply tubes are extended along the branches, it has drawbacks in that the air pressure supply tubes might become twisted around each other due to the rotation of the carrier transporter 40, which needs a certain operation to restore them to their initial positions, thereby lowering the efficiency of the polishing process.

In addition, it has drawbacks in that as the air pressure supply tubes are repeatedly twisted, when they are used for a long period of time, the possibility of developing a fatigue fracture is increased. Therefore, it causes problems by lowering the operational credibility of the rotary union which has to press down the substrates on the polishing platen with a predetermined pressure.

SUMMARY OF THE INVENTION

Objects of the Invention

These disadvantages of the prior art are overcome by the invention. It is an object of the invention to provide a chemical-mechanical polishing system in which even though a substrate carrier unit with loading a substrate moves through a circulatory path passing through a plurality of polishing platens, air pressure supply tubes for supplying compressed air to a rotary union are prevented from being twisted, thereby enabling to continuously polish the substrates loaded at the substrate carrier unit on the plurality of polishing platens.

Also, it is another object of the invention to provide a chemical-mechanical polishing system which allows two or more substrates to be consecutively polished to improve productivity and substantially prevents electrical wirings from being twisted during a simultaneous polishing process, thereby ensuring a reliable use of the system for a long period without failure.

Further, it is still another object of the invention to provide a chemical-mechanical polishing system to enable a control which moves a plurality of substrates only in one direction, thereby improving the efficiency of the process to simultaneously polish a plurality of substrates.

Construction of the Invention

In order to attain the above mentioned object, the invention provides a chemical-mechanical polishing apparatus, comprising: at least one polishing platens rotatably installed with a platen pad mounted on its upper surface; a guide rail disposed along a predetermined path; a substrate carrier unit including a rotary union to downwardly press a substrate during a polishing process, the substrate carrier unit moving along the guide rail with loading the substrate; and a docking unit installed to be docked to the substrate carrier unit so as to supply air pressure to the rotary union which downwardly presses the substrate held by the substrate carrier unit, when the substrate carrier unit is positioned over the polishing platen.

Hence, even though the first and second paths are formed in a separate path rather than a continuous one, the substrate carrier unit can be transported between the first and second paths separated from each other by the movement of the carrier holder, which makes it possible to form the travel path of the substrate carrier unit in a circulatory path without providing a curved path occupying a large space. That is, it can be appreciated that the travel path of the substrate carrier unit can be constructed in a circulatory shape, while its occupying space can be minimized.

In addition, since the travel path of the substrate carrier unit is not formed in a continuous shape and is constructed in such a manner that the separated paths are to be selectively connected through the movement of the carrier holder, it is possible to freely design the travel path of the substrate carrier unit in various shapes. For instance, the travel path of the substrate carrier unit can be formed in a rectangular, square, circular shape or any other shape.

Specifically, when the travel path of the substrate carrier unit is formed in a circulatory travel path, it has advantages in that it has excellent expandability. In other words, if the circulatory travel path is constructed as a single loop-shaped guide rail, the loop-shaped guide rail has to be disassembled so as to insert a new polishing platen into the circulatory travel path in a case that a new polishing platen needs to be added. However, according to the chemical mechanical polishing system of the invention, since the first and second paths are separated and can be connected to each other at a right angle, it can be easily expanded by inserting a frame provided with a polishing platen in the straight travel path.

Meanwhile, the invention provides a method for downwardly pressing a substrate carrier unit using a rotary union during the polishing process of a substrate mounted on the substrate carrier unit which moves along a predetermined path, including the steps of: moving the substrate carrier without an air pressure generating source to a predetermined position over a polishing platen; docking a docking unit disposed in a predetermined position to the substrate carrier unit; supplying compressed air from the docking unit to the substrate carrier unit; and driving the substrate carrier unit supplied with compressed air to press the mounted substrate downwardly.

As such, the substrate carrier unit of the chemical mechanical polishing system of the invention does not need driving sources for moving the substrate carrier unit or rotating the substrate, or an air pressure generating source for supplying compressed air to the rotary union, but only requires a part of delivering power. Hence, the substrate carrier unit is capable of traveling along a predetermined path by controlling the electric current of coils arranged outside thereof, and by being docked with the docking unit and then being supplied with an air pressure for driving the substrate to rotate. Therefore, even though the substrate carrier unit travels repeatedly along the circulatory path, the electrical wirings or air pressure supply tubes are not twisted.

In other words, it can be noted that since the substrate carrier unit is differently position-controlled and can move independently without effects of the electrical wirings or the like, it is possible to construct a single circulatory path with respect to plural polishing platens, and accordingly to simultaneously polish a plurality of substrates.

As described in the above, the invention is constructed in such a manner that the air pressure supply tubes following the movement of the substrate carrier unit does not required and then is removed, and that the docking unit is docked to the substrate carrier unit to deliver the rotational driving force to the substrate carrier unit in a position where the substrate loaded on the substrate carrier unit is polished. Hence, it should be appreciated that even when the substrate carrier unit travels to consecutively polish the substrates on a plurality of polishing platen, it may have advantages to substantially remove the phenomenon that the air pressure supply tubes become twisted due to the movement of the substrate carrier unit.

Further, it should be noted that the invention allows two or more substrates to be consecutively polished, which increases the productivity of the polishing process, and substantially prevents the air pressure supply tubes from being twisted during the simultaneous polishing processes of two or more substrates, thereby ensuring reliable use of the system without failure of the electrical wirings for a long period of time.

In addition, the invention makes it possible to control the movement of a plurality of substrates only in any one direction without twisting of the electrical wirings or the like, which improves the efficiency of the simultaneous polishing processes of the plural substrates.

BRIEF DESCRIPTION OF THE DRAWINGS

Accordingly, the invention will be understood best through consideration of, and reference to, the following Figures, viewed in conjunction with the Detailed Description of the Preferred Embodiment referring thereto, in which like reference numbers throughout the various Figures designate like structures and in which.

DETAILED DESCRIPTION OF THE INVENTION

The foregoing and other objects, features, aspects and advantages of the invention will become more apparent from the following detailed description of the invention when taken in conjunction with the accompanying drawings. In describing the invention, a detailed description of laid-out functions or structures is omitted in order to clarify the gist of the invention.

Figure 4:
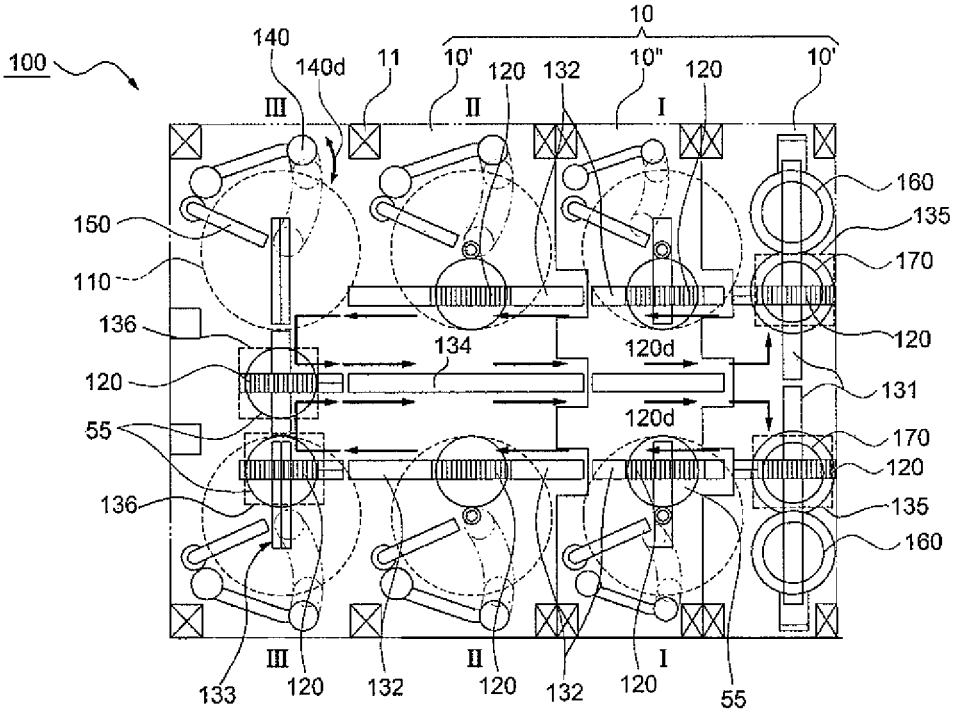
FIG. 4 is a plan view illustrating arrangements of a chemical mechanical polishing system in accordance with a preferred embodiment of the invention.
Figure 5:
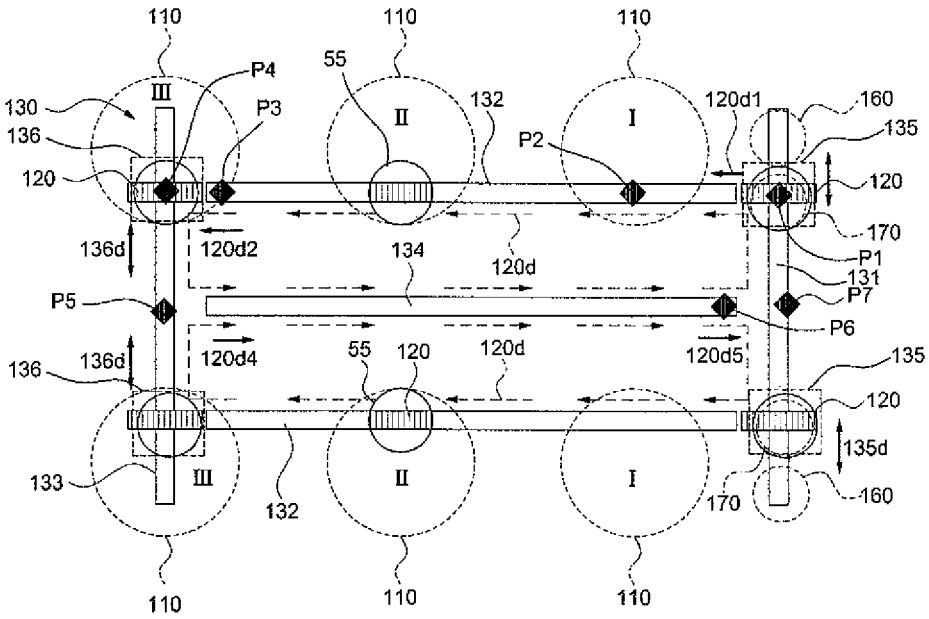
FIG. 5 is a schematic view illustrating a circulatory path in FIG. 4.
Figure 6:
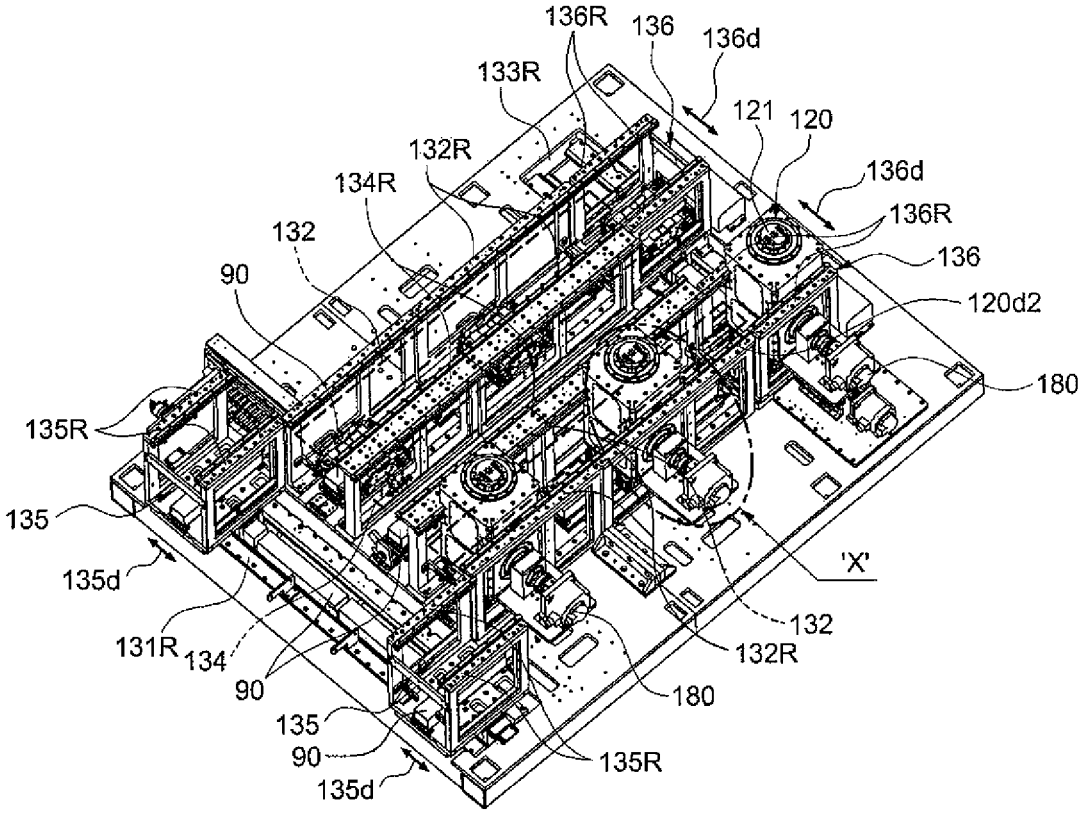
FIG. 6 is a perspective bottom view of constructions of the chemical mechanical polishing system excluding the polishing platen.
Figure 7:
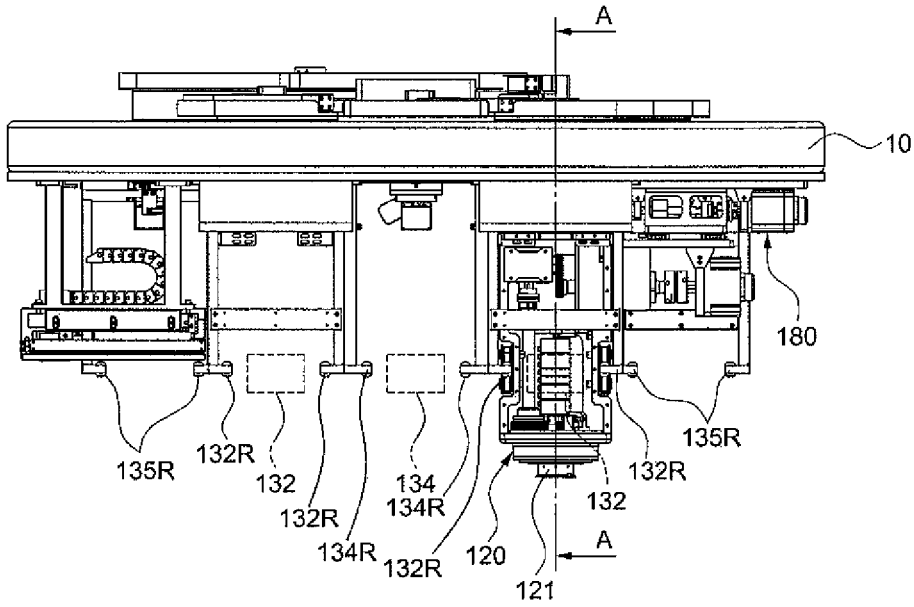
FIG. 7 is a side elevation view of FIG. 4.
Figure 8:
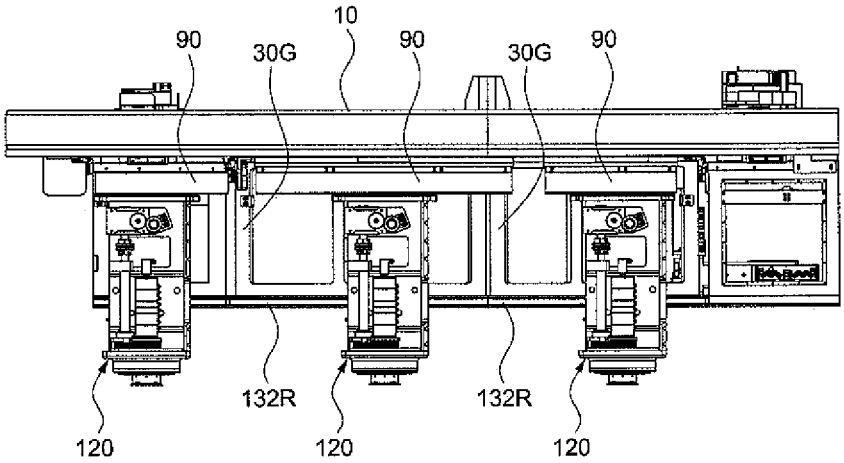
FIG. 8 is a longitudinal cross sectional view by a cut line A-A of FIG. 7.
Figure 9:
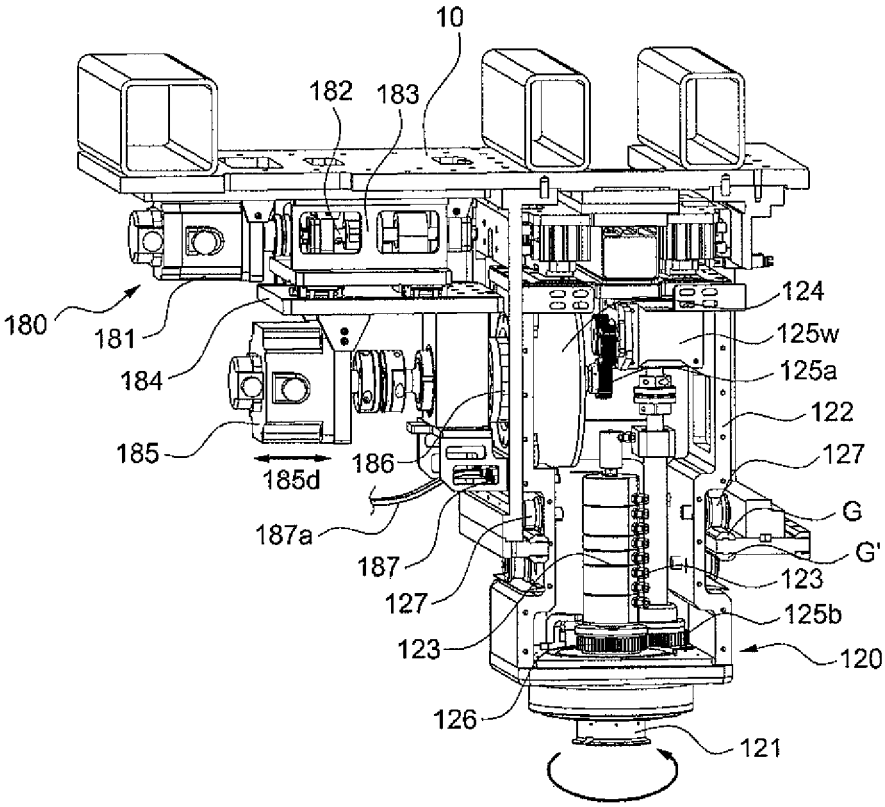
FIG. 9 is an enlarged perspective view of 'X' in FIG. 6.
Figure 10:
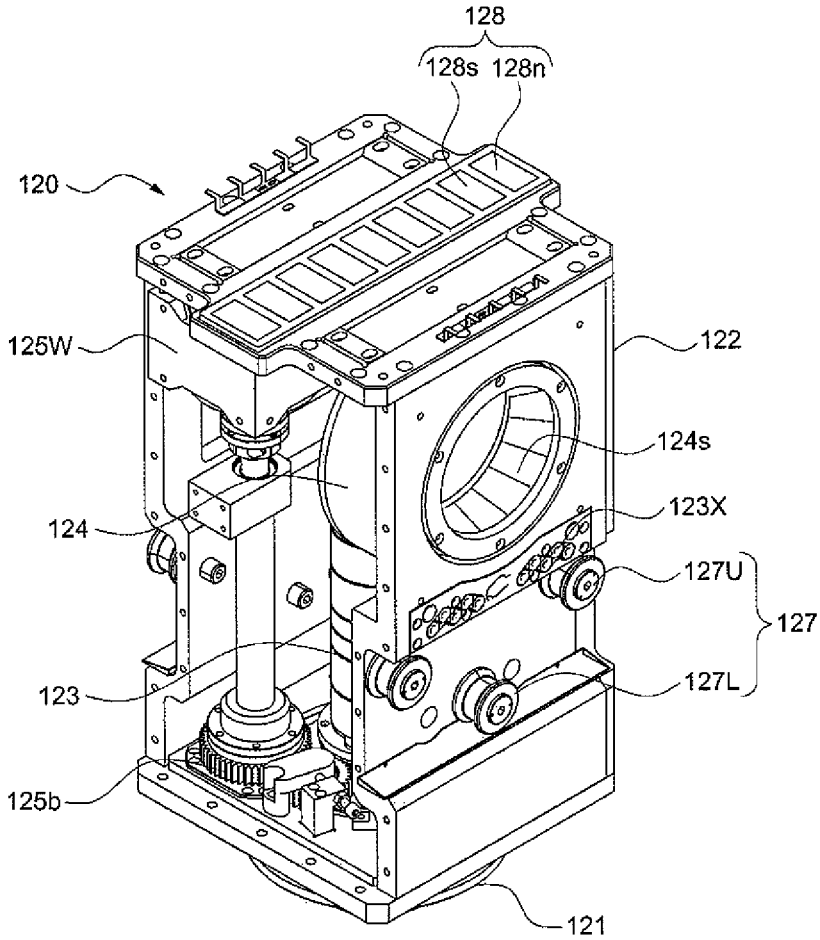
FIG. 10 is a cut-away perspective view of a substrate carrier unit of FIG. 9.
Figure 11:
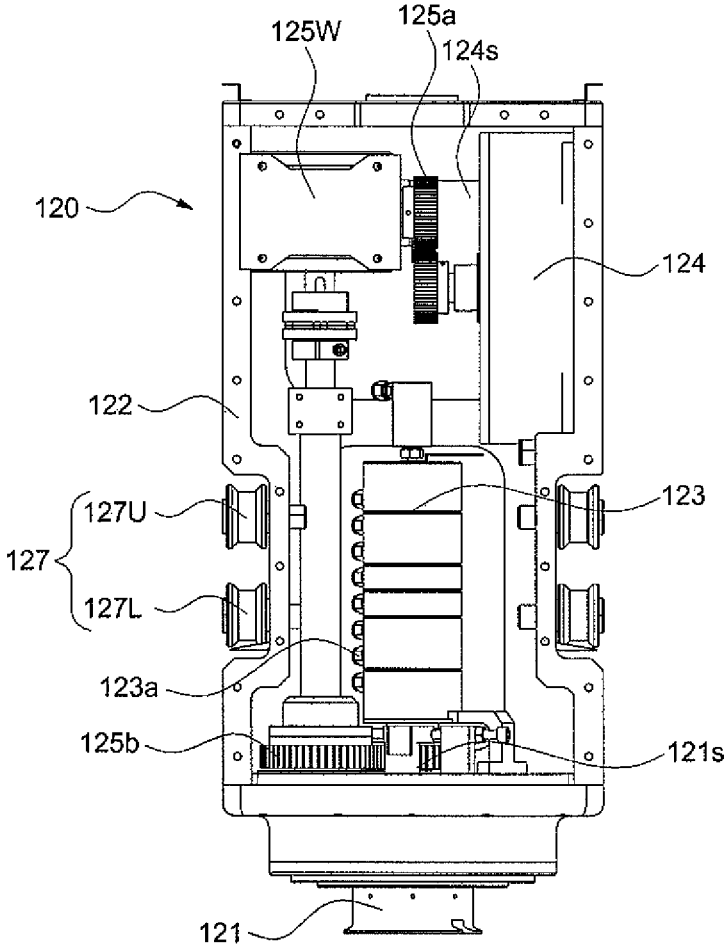
FIG. 11 is a side elevation view of FIG. 10.
Figure 12:
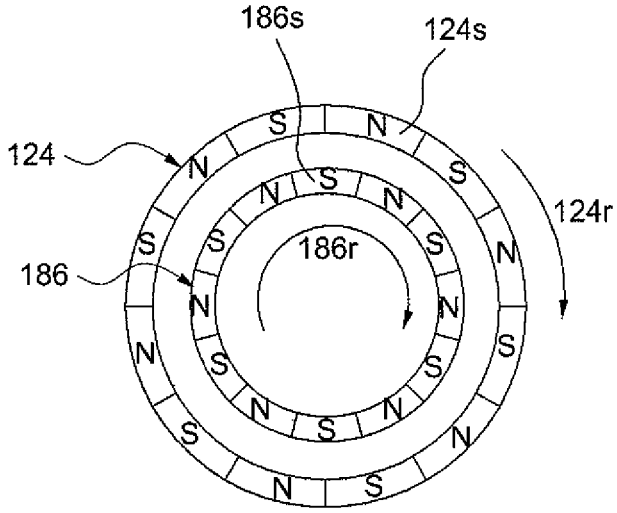
FIG. 12 is a schematic view illustrating a construction wherein the rotational driving force of a docking unit is delivered to a driven shaft of the substrate carrier unit.

FIG. 4 is a plan view illustrating arrangements of a chemical mechanical polishing system in accordance with a preferred embodiment of the invention, FIG. 5 is a schematic view illustrating a circulatory path in FIG. 4, FIG. 6 is a perspective bottom view of constructions of the chemical mechanical polishing system excluding the polishing platen, FIG. 7 is a side elevation view of FIG. 4, FIG. 8 is a longitudinal cross sectional view by a cut line A-A of FIG. 7, FIG. 9 is an enlarged perspective view of 'X' in FIG. 6, FIG. 10 is a cut away perspective view of a substrate carrier unit of FIG. 9, FIG. 11 is a side elevation view of FIG. 10, and FIG. 12 is a schematic view illustrating a construction wherein the rotational driving force of a docking unit is delivered to a driven shaft of the substrate carrier unit; and As shown in the drawings, a chemical mechanical polishing system 100 in accordance with a preferred embodiment of the invention, includes: a plurality of polishing platens 110 rotatably installed at a frame 10 and having a platen pad mounted on its upper surface; a substrate carrier unit 120 provided with a rotary union 123 therein, moving with a substrate 55 mounted on its lower part to polish the mounted substrate 55 on the polishing platen 110; guide rails 132R, 134R, 135R and 136R for moving or holding the substrate carrier unit 120 along a predetermined path 130; a slurry supply unit 150 for supplying slurry on the platen pad when the substrate 55 rotates to be polished on the polishing platen 110; a conditioner 140 for uniformly supplying the slurry supplied by the slurry supply unit 150 on the platen pad; a substrate loading unit 160 for providing the substrate 55 to be polished to the substrate carrier unit 120 positioned on the path 130; a substrate unloading unit 170 for unloading the polished substrate 55 from the substrate carrier unit 120; and a docking unit 180 docked to the substrate carrier unit 120 so as to supply an air pressure to the rotary union 123 of the substrate carrier unit 120 and deliver the rotational driving force to turn the substrate 55 when the substrate carrier unit 120 is positioned over the polishing platen 110.

Figure 1:
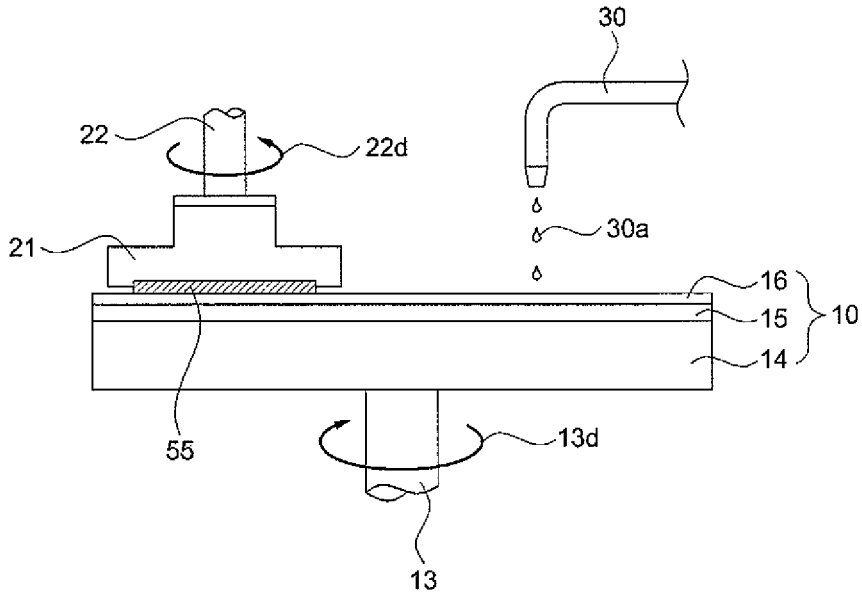
FIG. 1 is a schematic view illustrating constructions of a general chemical mechanical polishing system in the prior art.
Figure 2:
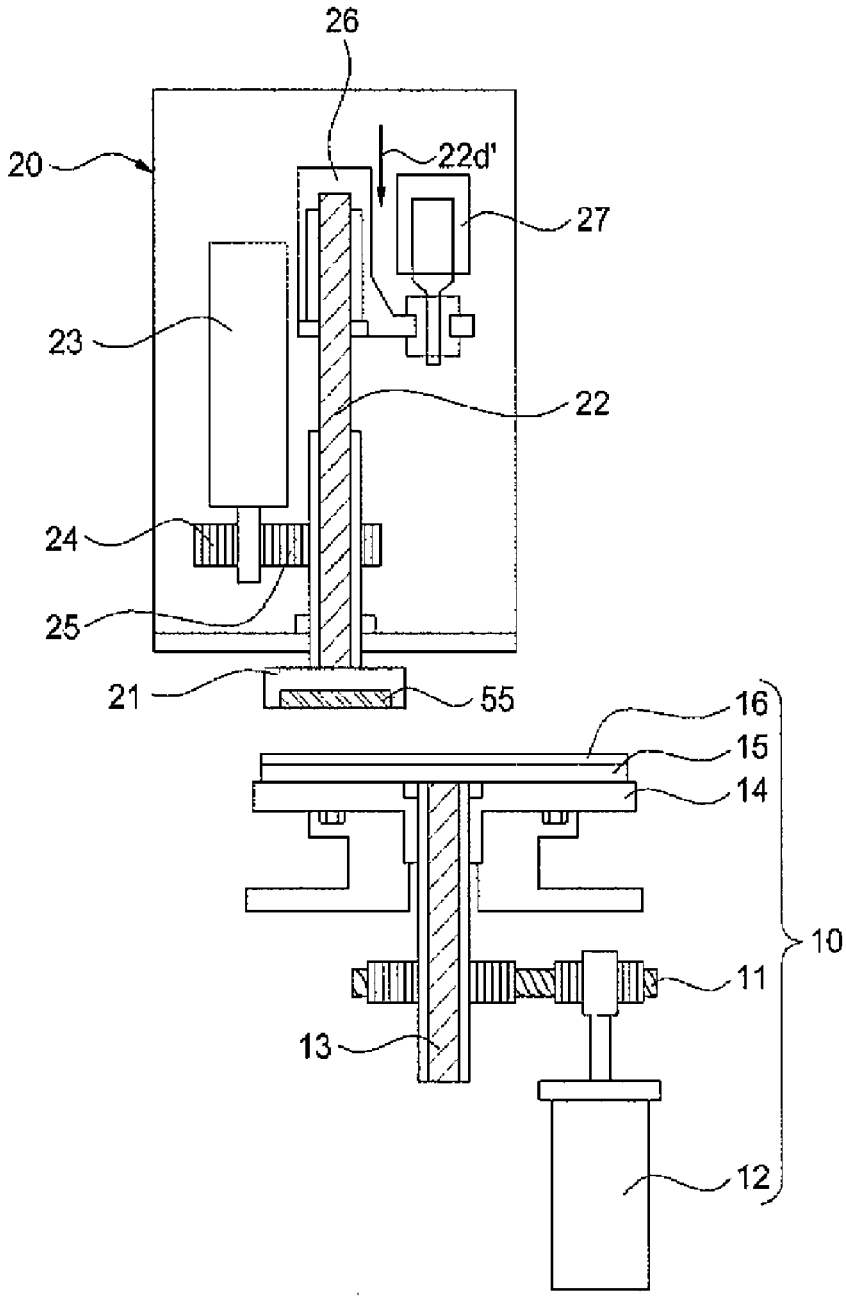
FIG. 2 is a detailed cross sectional view of constructions of a polishing platen and a carrier unit of FIG. 1.
Figure 3:
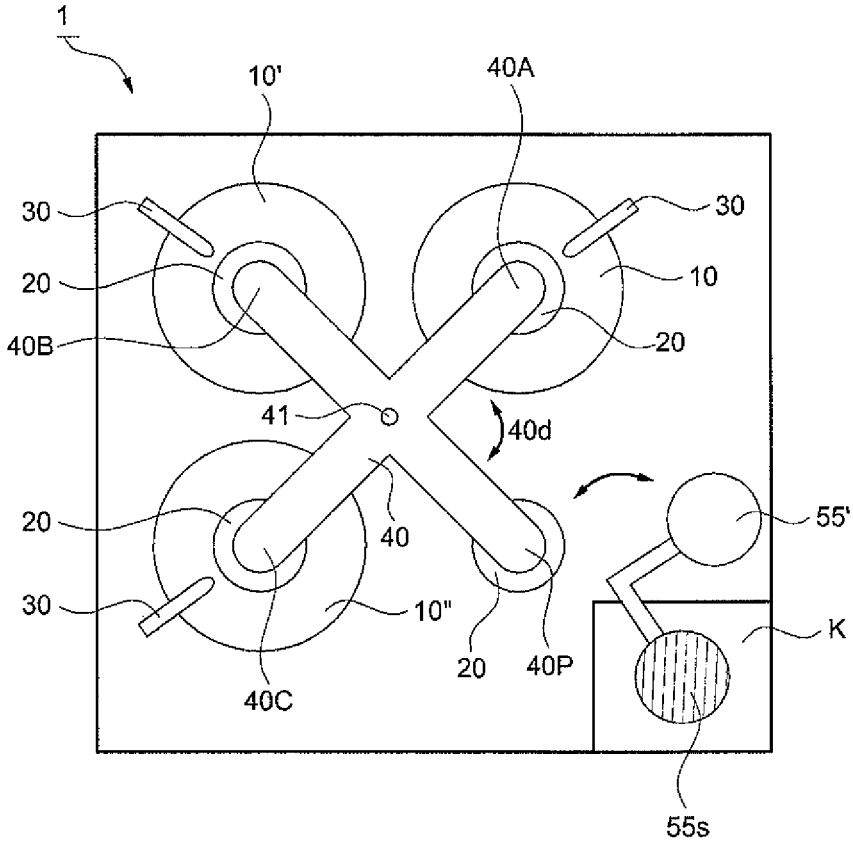
FIG. 3 is a plan view of FIG. 1.

The polishing platen 110 is rotatably secured to a frame 10, 10' and 10" to polish the substrate 55 such as a wafer or the like. A platen pad for polishing the substrate 55 is attached onto its uppermost layer, and a backing layer of softer material interposed beneath the platen pad, whose individual construction becomes similar to or the same as the polishing platen 10 shown in FIG. 3.

Herein, a plurality of polishing platens 110 are arranged in a first path 132 out of a circulatory path 130 which includes paths arrayed in a non-consecutive and separate manner with a straight pattern. Referring to FIG. 5, in the first path 132, the substrate carrier unit 120 is operated to move the substrate 55 only in one (left) direction to be polished on the polishing platen 110. As such, the substrate 55 to be polished is uniformly moved only in one direction to perform the polishing process of the substrate 55, thereby improving the efficiency of the polishing process.

The conditioner 140, when the slurry is supplied on the platen pad of the polishing platen 110 from the slurry supply unit 150, performs a sweeping movement in a direction as indicated by reference numeral 140*d* in the drawings to allow the slurry on the platen pad to be uniformly spread. Hence, the slurry being supplied is uniformly applied on the substrate 55 in a sufficient quantity, while the substrate 55 mounted on a carrier head 121 comes in contact with the platen pad and rotates relatively to the latter.

The slurry supply unit 150 is designed to supply the slurry onto the platen pad of the polishing platen 110. In the case that the polishing process needs to be performed with two or more kinds of the slurry to polish the substrate 55, the polishing process has to be carried out on respective different polishing platens 110. To this end, the slurry to be supplied onto the polishing platen 110 is not uniformly applied, and proper slurry is selected and supplied in turn onto the polishing platen 110 depending upon the polishing process.

The circulatory path 130, as shown in FIGS. 4 to 6, includes two rows of a first path 132 passing through the plural polishing platens 110, a third path 134 disposed parallel to the first path 132 between two rows of the first rows 132, and a pair of second paths 131 and 133 arranged at opposite ends of the first path 132 and the third path 134. Here, the first path 132 is defined by a first guide rail 132R, the second paths 131 and 133 by a fixed rail 131R and 133R, and the third path 134 by a third guide rail 134R.

The respective paths 131 to 134 are arranged in the form of unconnected plural paths with one another. Carrier holders 135 and 136 make the substrate carrier unit 120 travel across the unconnected paths because the carrier holders 135 and 136 can accommodate and move together with the substrate carrier unit 120 across the unconnected paths. Therefore, the carrier holders 135 and 136 are provided in the second paths 131 and 133, so that the substrate carrier unit 120 can be in a state where it can travel through the segmented paths 131 to 134 only when carrier holders 135 and 136 reach positions P1, P2, P3, P4 and P5 at which the substrate carrier unit 120 can be transferred to the first path 132 or the third path 134. In other words, the substrate carrier unit 120 moves by itself along the first guide rail 132R and the third guide rail 134R in the first path 132 and the third path 134, respectively. However, the substrate carrier unit 120 cannot move solely along fixed rails 131R and 133R in the second paths 131 and 133, and the substrate carrier unit 120 only can move along the fixed rails 131R and 133R by the movement of the carrier holders 135 and 136 after being in a state of being accommodated at the carrier holders 135 and 136.

At this point, it is more effective to orient the substrate carrier unit 120 in a selected direction at all times when it travels along the circulatory path 130 so as to control the movement of the substrate carrier unit 120, and it is advantageous in the aspect of arrangement of the docking unit 180 described hereinafter. To this end, as shown in FIG. 6, the carrier holders 135 and 136 are provided with a pair of second guide rails 135R and 136R which face the same direction and have the same dimensions and spacing as the first guide rail 132R and the third guide rail 134R to define the first path 132 and the third path 134. Therefore, it is possible to maintain the directions to be constant so that the substrate carrier unit 120 faces when being positioned in the second guide rails 135R and 136R and when being positioned in the first guide rail 132R and the third guide rail 134R. As the first guide rail 132R and the third guide rail 134R are formed with the same dimensions and spacing, the substrate carrier unit 120 can smoothly and easily travel back and forth from the first path 132 and the third path 134 to the second paths 131 and 133.

Meanwhile, in the chemical mechanical polishing system of the invention, the second paths 131 and 133 which are spaced apart and arranged at right angles at the opposite ends of the first path 132 and the third path 134 are separated from each other. However, it is possible to move the substrate carrier unit 120 in a path, where the directional turning point of the circulatory path 130 is formed like a vertex, by virtue of a selective connection through the carrier holders 135 and 136, which makes it possible to array the circulatory path 130 in the shape of a rectangle, a triangle or the like. Accordingly, as shown in FIG. 7, the third guide rail 134R for guiding the third path 134 can be closely arranged without any gaps with the first guide rail 132R for guiding the first path 132. In other words, it is possible to manufacture the path of the substrate carrier unit 120 in a compact and close manner.

Since the chemical mechanical polishing system of the invention has arrangements of having the carrier holders 135 and 136, it is possible to array the same in a rectangular shape, thereby embodying a compact facility. Further, as shown in FIG. 4, it has advantages in that the present system can easily increase or decrease the number of the polishing platens by inserting or withdrawing the frame 10" having the polishing platen 110, the first guide rail 132R and third guide rail 134R to/from the existing facility. Similarly, the number of the polishing platens can be simply adjusted through selectively adding or removing the first path 132 and the third path 134 with respect to the construction shown in FIG. 5. As such, the chemical mechanical polishing system of the invention allows the polishing facility to be easily expanded depending upon a production scheme.

For the purpose as such, coils 90 arrayed parallel and facing to the travel path of the substrate carrier unit 120, more specifically arrayed along the first path 132 and the third path 134 in which a plurality of polishing platens 110 are located, are not formed in a unitary member with a single path, but arrayed in a segmented pattern. Hence, in the case that requires an increase in the number of polishing platens 110 of the chemical mechanical polishing system 100, it is possible to insert a frame module provided with the polishing platen 110 and the segmented coils 90. Therefore, the substrate carrier unit 120 can consecutively move along the segmented coils 90 of the newly inserted frame and the segmented coils 90 of the existing frame, which makes it easy to expand the number of the polishing platens and has advantages in that each frame can be fabricated by a unit of a module.

The substrate carrier unit 120 having various components 123 to 127 fixed within its casing 122 is controlled to move along the path 130, and the plural substrate carrier units 120 are independently controlled to move individually. In FIG. 4, the substrate carrier unit 120 is indicated by 'densely packed vertical lines'.

During the process in that the substrate carrier unit 120 is moving in a direction indicated by reference numeral 120*d* along the circulatory path 130, the substrate carrier unit 120 travels along the straight guide rails 132R, 133R, 134R, 135R and 136R arranged at opposite sides thereof. Hence, the substrate carrier unit 120 maintains its posture facing a constant direction all the time, so it experiences only a translational movement, not a rotational movement during its transportation.

Referring to FIG. 10, each substrate carrier unit 120, includes: a carrier head 121 for holding the substrate 55, a rotary union 123 for pressing the substrate 55 in its surface direction with allowing its rotation, a driven shaft 124 having a hollow part to receive a rotational driving force from a docking unit 180, power transmission elements 125 composed of a shaft, a gear or the like for transmitting the rotational driving force delivered to the driven shaft 124, a follower gear installed on the rotating shaft of the carrier head 121 for driving the carrier head 121 through the rotational driving force delivered by the power transmission elements 125, a guide roller rotatably installed at the opposite upper and lower parts of the substrate carrier unit 120 for receiving guide rails 132R, 134R, 135R and 136R in a space formed therebetween, and a permanent magnetic strip 128 alternatively arrayed with a N-pole permanent magnet 128*n* and a S-pole permanent magnet 128*s* on its upper surface for moving the substrate carrier unit 120 using a linear motor principle.

Here, the rotary union 123 is constructed similarly to constructions and operations disclosed in the Korea Patent Laid-Open No. 2004-75114.

Meanwhile, the first guide rail 132R of the first path 132, the third guide rail 134R of the third path 134, and the fixed rails 131R and 133R of the second paths 131 and 133 are fixedly secured to the frame 10. At this point, the first guide rail 132R and the third guide rail 134R are connected and fixed to a bracket 30G which is extended downwardly from the frame 10.

In order to transport the substrate carrier unit 120 along the first path 132 and the third path 134, the coils 90 are arranged and spaced apart from the permanent magnet strip 128 provided on the upper part of the substrate carrier unit 120 along the direction of the paths 132 and 133. Hence, by adjusting the intensity and direction of the electric current applied to the coils 90, the substrate carrier unit 120 moves, guided by the guide rails 132R and 134R along the first path 132 and the third path 134 by the operational principle of a linear motor through the co-operation of the coils 90 and the permanent magnetic strip. Besides, for the purpose of moving the carrier holders 135 and 136 holding the substrate carrier unit 120 along the second paths 131 and 133, the coils 90 are arrayed and spaced apart from the permanent magnetic strip (not shown) provided on the upper part of the substrate carrier unit 120. Accordingly, by adjusting the intensity and direction of the electric current applied to the coils 90, the carrier holders 135 and 136 move, guided by the fixed rails 131R and 133R along the second paths 131 and 133 by the operational principle of a linear motor through the co-operation of the coils 90 and the permanent magnetic strip.

Similarly, in order to allow the substrate carrier unit 120 to move back and forth through the carrier holders 135 and 136 between the first path 132 and the third path 134, the coils 90 are arranged on the upper part of the carrier holders 135 and 136, so that the substrate carrier unit 120 can move outside and inside of the carrier holders 135 and 136 by the co-operation with the permanent magnet strip 128 arrayed on the upper part of the substrate carrier unit 120.

As for the guide rails 132R, 134R, 135R and 136R received between the upper guide roller 127U and the lower guide roller 127L of the substrate carrier unit 120, soundproofing rails G and G' of a rubber material are attached to the end portions of the guide rails 132R, 134R, 135R and 136R contacting with the guide rollers 127, 127U and 127L, as shown in FIG. 9, so as to allow more silent movement thereof.

The docking unit 180, as shown in FIG. 9, is secured to the frame 10. When the substrate carrier unit 120 is sensed to arrive at a predetermined position, the docking unit 180 is docked to the substrate carrier unit 120 to transmit a rotational driving force for rotating the substrate 55 and an air pressure needed for the rotary union 123. To this end, the docking unit 180, includes: a docking motor 181 for enabling or releasing a docking state with the substrate carrier unit 120, a lead screw 182 rotated by the docking motor 181, a movement block 183 provided with female screws to be engaged with the lead screw 182, wherein the movement block 183 is installed with its rotation restrained and moves in a direction indicated by reference numeral 185*d* through the rotation of the lead screw 182, a supporting body 184 coupled with the movement block 183, moving together with the movement block 183 in a unitary manner, a driving motor 185 fixed to the supporting body 184 for generating a rotational driving force, a coupling shaft 186 connected to and rotated by the driving motor 185, and a plurality of compressed air ports 187 connected to and moved together with the supporting body 184 for supplying compressed air through the air pressure supply tube 187*a* to the rotary union 123 of the substrate carrier unit 120.

Referring to FIG. 9, the substrate carrier unit 120 is not provided with a driving source to generate a rotational driving force or an air pressure, so it needs to be supplied with a rotational driving force or an air pressure from the outside to perform a polishing process of the substrate 55 mounted at the substrate carrier unit 120. Hence, when the substrate 55 mounted at the substrate carrier unit 120 reaches a predetermined position on the polishing platen 110, the polishing platen 110 moves upwards, and then the platen pad of the polishing platen 110 comes in contact with the substrate 55.

When the docking motor 181 of the docking unit 180 turns in a normal direction, the movement block 183 whose rotation has been restrained moves toward the substrate carrier unit 120 by rotation of the lead screw 182. The supporting body 183, the driving motor 185 coupled to the supporting body 183 and the coupling shaft 186 move together toward the substrate carrier unit 120 according to the movement of the movement block 183, so that the coupling shaft 186 is received within the driven hollow shaft 124 with a certain spacing and the compressed air ports 187 are inserted into the air pressure receiving port 123*x* of the substrate carrier unit 120, which constitutes a docking state.

At this point, as shown in FIG. 12, approximately six to twelve permanent magnetic strips 186*s* consisting of alternatively arrayed N-pole permanent magnets and S-pole permanent magnets are arranged on the outer periphery of the coupling shaft 186, while about six to twelve permanent magnetic strips 124*s* consisting of alternatively arrayed N-pole permanent magnets and S-pole permanent magnets are arranged on the inner periphery of the driven shaft 124 having the hollow part 186. Hence, when the coupling shaft 186 rotates in a direction indicated by reference numeral 186*r*, a rotational driving force, which is created by the cooperation of the magnetic forces of the permanent magnetic strips 124*s* arranged on the inner periphery of the hollow part of the driven shaft 124 and the permanent magnetic strips 186*s* arranged on the outer periphery of the coupling shaft 186, is transferred from the coupling shaft 186 of the docking unit 180 to the driven shaft 124 to turn the same together in the same direction as indicated by reference numeral 124*r*. In other words, the coupling shaft 186 provided with alternatively arrayed N-pole permanent magnets and S-pole permanent magnets at its outer periphery and the driven shaft 124 provided with alternatively arrayed N-pole permanent magnets and S-pole permanent magnets at its inner periphery constitute a magnetic coupling and transfer the rotational driving force generated by the driving motor 185 to the substrate carrier unit 120. The rotational driving force delivered to the substrate carrier unit 120 is transmitted to a pinion 125*a* rotated together with the driven hollow shaft 124, and to a transmitting gear 125*b* through a worm gear box 125*w*, thereby driving the carrier head 121 mounted with the substrate 55.

As described above, the rotational driving force of the driving motor 185 is transferred to the substrate carrier unit 120 using the magnetic coupling formed by the shafts 124 and 186. Hence, it can be appreciated that even when the substrate carrier unit 120 is not positioned exactly at the predetermined position, leaving a small positional error, the position control of the substrate carrier unit 120 can be performed easily as the rotational driving force is transferred through a non-contact magnetic coupling by the shafts 124 and 186. Further, it is possible to stably deliver the rotational driving force generated from the outside of the substrate carrier unit 120 to the inside of the substrate carrier unit 120.

Figure 13:
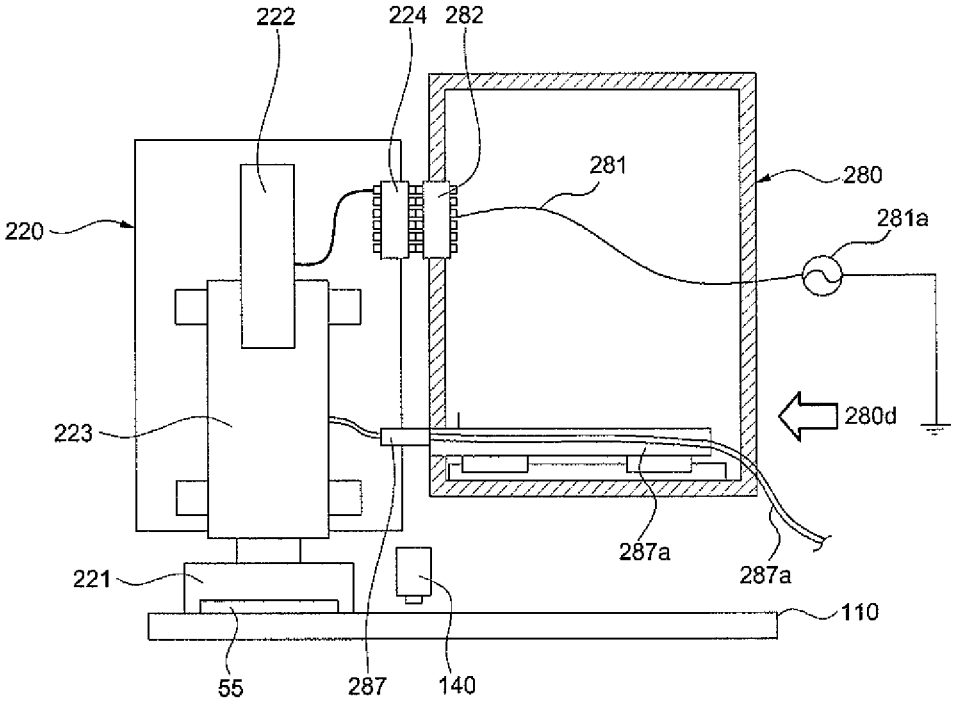
FIG. 13 is a schematic view illustrating the delivery of an electrical power of a rotational driving force of a docking unit to the substrate carrier unit.

As shown in FIG. 13 which illustrates another embodiment of the invention, in a state where the docking unit 280 is docked to the substrate carrier unit 220, it is possible that the air pressure connecting port 287 of the air pressure supply tube 287*a* of the docking unit 280 is connected to the air pressure receiving port 123*x* of the substrate carrier unit 220 to supply an air pressure necessary for the rotary union 223 of the substrate carrier unit 220. FIG. 13 shows another type of construction of the invention wherein a motor 222 for rotating the substrate 55 is mounted on the substrate carrier unit 220, and an electrical power source 281*a* for driving the motor 222 and control signals are transmitted from the docking unit 280 to the substrate carrier unit 220 through connectors 224 and 282.

Referring back to FIG. 9, when the air pressure connecting port 187 of the docking unit 120 is connected to the air pressure receiving port 123*x* of the substrate carrier unit 120 (though the air pressure supply tube within the substrate carrier unit 120 is not shown in the drawings), the compressed air is supplied to a plurality of air pressure receiving ports 123*a* of the rotary union 123 through the air pressure supply tubes 187*a*, respectively. As shown in FIG. 9, since the compressed air has to be delivered to the rotary union 123 at different heights, the air pressure supply tube 187*a* and the air pressure connecting port 187 have to be connected in the same number as those of the air pressure receiving port 123*x* at the same time, delivering the air pressure from the outside to the rotary union 123.

When the substrate carrier unit 120 completes all the polishing processes for the substrate 55 mounted thereon at a predetermined position, the docking motor 181 rotates in a reverse direction to release the docking state between the docking unit 180 and the substrate carrier unit 120. Then, the substrate carrier unit 120 moves to another polishing platen for performing a next polishing process, otherwise it moves to the substrate unloading unit 170 of the second path 131 through another second path 133 and the third path 134 when all of the polishing process is finished.

Hereinafter, an operational principle of a substrate transferring system of the chemical mechanical polishing apparatus in accordance with a preferred embodiment of the invention is illustrated in detail with reference to FIG. 5.

Step 1: First, a substrate carrier unit 120 in a state positioned in a carrier holder 135 is loaded with a substrate 55 from a substrate loading unit 160. By adjusting an electrical current applied to an upper coil of the carrier holder 135, the carrier holder 135 is then moved to reach the position P1 along a fixed rail 131R defining a second path 131. At the position P1, since a second guide rail 135R arrayed at the carrier holder 135 is substantially consecutively arranged with a first guide rail 132R of a first path 132, the carrier holder 135 can be transferred smoothly from the second path 131 to the first path 132 without any impact.

Step 2: By adjusting an electrical current flowing in the coils installed at the upper part of the carrier holder 135, the substrate carrier unit 120 positioned in the carrier holder 135 is transported in a linear motor manner from the second path 131 to a direction indicated by reference numeral 120*d*1, arriving at the first path 132. And then, the substrate carrier unit 120 moves to a first polishing platen I to be firstly polished, reaching a position P2.

When the substrate carrier unit 120 is sensed to reach the first polishing platen I, a docking motor 181 of a docking unit 180 is driven to create a state in which the rotational driving force of the driving motor 185 of the docking unit 180 can be transmitted to the substrate carrier unit 120. At the same time, the air pressure of the docking unit 180 is delivered to a rotary union 123 to create a state which can press down the substrate 55 towards a platen pad 111. Meanwhile, when the air pressure is delivered to the rotary union 123, the inner chamber of the rotary union 123 is expanded to move the substrate 55 mounted on a carrier head 121 downwardly, creating a state wherein the substrate 55 comes in contact with the platen pad 111. Thereafter, the rotational driving force is transferred from the docking unit 180 to turn the substrate 55, so it is possible to perform a chemical mechanical polishing process against the substrate 55 mounted on the substrate carrier unit 120. Here, even though there is neither a driving source for rotating the substrate 55 in the substrate carrier unit 120 nor a compressed air source for supplying an air pressure to the rotary union 123, a chemical mechanical polishing process of the substrate 55 can be performed on the polishing platen I through docking of the docking unit 180.

Even if the substrate carrier unit is transported after the completion of the polishing process, since the air pressure of the rotary union can be maintained in a negative pressure state through a check valve installed at the substrate carrier unit, it is possible to keep the substrate carrier unit holding the substrate with the air pressure of the rotary union.

As such, the chemical mechanical polishing system in accordance with the invention has constructions wherein the electrical wirings and air pressure supply tubes following the movement of the conventional substrate carrier unit for rotating the substrate 55 mounted in the substrate carrier unit 120 are removed, and further the docking unit 180 is docked to the substrate carrier unit 120 at a polishing position P2, where the substrate 55 is mounted on the substrate carrier unit 120, to deliver the rotational driving force and air pressure to the substrate carrier unit 120. Therefore, the invention substantially resolves the phenomenon in which the air pressure supply tubes are twisted by the movement of the substrate carrier unit 120, which makes it possible to consecutively polish the substrates 55 on the plural polishing platens I, II and III. In addition, since it is possible to perform a circulatory movement control that moves a plurality of substrates 55 in any one direction without the twisting of electrical wirings or the like, it can increase the number of the substrates passing through the polishing process per unit hour, enhancing the productivity of the polishing process.

Step 3: After that, polishing processes are performed on one or plural polishing platens from among a first polishing platen I, second polishing platen II, third polishing platen III, and so on depending upon the kinds of the substrate. Meanwhile, although not shown in the drawings, according to another embodiment of the invention, except for the substrate carrier unit 120 under the polishing operation on the polishing platen 110, there is provided another waiting substrate carrier unit, thereby improving the polishing efficiency at the polishing platen 110.

Step 4: Next, when the polishing process of the substrate 55 is completed, the substrate carrier unit 120 moves to a position P3 through a control of the electrical current of the coils in the first path 132. When the substrate carrier unit 120 arrives at the position P3, a carrier holder 136 of a second path 133 moves to a position P4 and enables a second guide rail 136R of the carrier holder 136 to be in a consecutive arrangement with the first guide rail 132R of the first path 132. Hence, the substrate carrier unit 120 of the first path 132 can be smoothly transferred in a direction indicated by reference numeral 120*d*2 to the second path 133.

And then, the carrier holder 136 receiving the substrate carrier unit 120 moves in a direction indicated by reference numeral 136*d*, and a third guide rail 134R of a third path 134 is consecutively arranged with a second guide rail 136R of the carrier holder 136.

Step 5: Thereafter, both the substrate carrier unit 120 which performs a polishing process in the upper first path 132 and the substrate carrier unit 120 which performs a polishing process in the lower first path 132 release the substrate through the third path 134. To this end, the substrate carrier unit 120 in the second path 133 moves in a direction as indicated by reference numeral 120*d*4 and is transferred to the third path 134, and then it moves to a position P6 along the third path 134.

When the substrate carrier unit 120 reaches the position P6, the carrier holder 135 of the second path 131 moves to a position P7 and enables the second guide rail 135R of the carrier holder 135 to be in a consecutive arrangement with the third guide rail 134R of the third path 134. Hence, the substrate carrier unit 120 of the third path 134 can be smoothly transferred in a direction indicated by reference numeral 120*d*5 to the second path 133.

Step 6: Then, the substrate carrier unit 120 received in the carrier holder 135 of the second path 131 moves to a substrate unloading unit 170, and the substrate whose polishing process is completed is released. Thereafter, Steps 1 to 6 are repeated.

INDUSTRIAL APPLICABILITY

As described hereinabove, the substrate carrier unit 120 is docked to the docking unit 140 only in the polishing process of the substrate 55, which needs electrical signals and an air pressure, in order to receive electrical signals, rotational diving forces, and an air pressure necessary for driving the rotary union 123. Hence, it has advantages in that the substrate carrier unit 120 can freely move along the path 130 without causing the electrical wirings and air pressure supply tubes 183*a* to be twisted. Furthermore, if the substrate carrier unit 120 does not carry a motor therein, it can prevent the electrical wirings from being twisted as well as lower the weight of the substrate carrier unit 120. Therefore, it can be appreciated that it is easy to control the movement of the substrate carrier unit 120 due to its light-weight and can reduce the power consumption necessary for moving the substrate carrier unit 120.

As the invention can be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

Having described the invention, the following is claimed:

1. A chemical-mechanical polishing apparatus, comprising:

at least one polishing platens rotatably installed with a platen pad mounted on its upper surface;

a guide rail disposed along a predetermined path;

a substrate carrier unit including a rotary union to downwardly press a substrate during a polishing process, the substrate carrier unit moving along the guide rail with loading the substrate; and a docking unit installed to be docked to the substrate carrier unit so as to supply air pressure to the rotary union which downwardly presses the substrate held by the substrate carrier unit, when the substrate carrier unit is positioned over the polishing platen, wherein the path has a first path and a second path, said path including an unconnected path between the first path and the second path, wherein the substrate carrier unit is carried across the unconnected path by a carrier holder which accommodates the substrate carrier unit and moves across the unconnected path between the first path and the second path whereby the substrate carrier unit travels through the path.

2. The chemical-mechanical polishing apparatus as claimed claim 1, wherein the substrate carrier unit does not carry neither a driving source nor an electrical power source, and wherein an air pressure supply tube is connected to the substrate carrier unit during the substrate polishing process.

3. The chemical-mechanical polishing apparatus as claimed in claim 1, wherein a plurality of polishing platens are provided along the path, and the guide rail is arranged to allow the substrate carrier unit to pass through the plurality of polishing platens.

4. The chemical-mechanical polishing apparatus as claimed claim 3, wherein the substrate carrier unit does not carry neither a driving source nor an electrical power source, and wherein an air pressure supply tube is connected to the substrate carrier unit during the substrate polishing process.

5. The chemical-mechanical polishing apparatus as claimed in claim 3, wherein the path is a circulatory path.

6. The chemical-mechanical polishing apparatus as claimed claim 5, wherein the substrate carrier unit does not carry neither a driving source nor an electrical power source, and wherein an air pressure supply tube is connected to the substrate carrier unit during the substrate polishing process.

7. The chemical-mechanical polishing apparatus as claimed in claim 5, wherein the guide rail is formed in a closed loop.

8. The chemical-mechanical polishing apparatus as claimed in claim 7, wherein the substrate carrier unit does not carry neither a driving source nor an electrical power source, and wherein an air pressure supply tube is connected to the substrate carrier unit during the substrate polishing process.

9. The chemical-mechanical polishing apparatus as claimed in claim 1, wherein the substrate carrier unit does not carry neither a driving source nor an electrical power source, and wherein an air pressure supply tube is connected to the substrate carrier unit during the substrate polishing process.

* * * * *